US006561086B2

(12) United States Patent
Miyachi et al.

(10) Patent No.: US 6,561,086 B2
(45) Date of Patent: May 13, 2003

(54) AUTOMATIC ALIGNING PRESSING APPARATUS

(75) Inventors: Hiroshi Miyachi, Tsukuba-gun (JP); Seiji Takanashi, Tsukuba-gun (JP); Satoshi Suzuki, Tsukuba-gun (JP)

(73) Assignee: SMC Corporation, Tokyo (JP)

( * ) Notice: Subject to any disclaimer, the term of this patent is extended or adjusted under 35 U.S.C. 154(b) by 27 days.

(21) Appl. No.: 09/799,566

(22) Filed: Mar. 7, 2001

(65) Prior Publication Data

US 2001/0027727 A1 Oct. 11, 2001

(30) Foreign Application Priority Data

Apr. 3, 2000 (JP) ..... 2000-100679
Aug. 24, 2000 (JP) ..... 2000-254287
Nov. 1, 2000 (JP) ..... 2000-334418

(51) Int. Cl.[7] ..... B30B 5/00; B30B 15/10
(52) U.S. Cl. ..... 100/258 R; 100/219; 100/260; 269/21; 384/108
(58) Field of Search ..... 100/258 R, 219, 100/224, 260; 384/12, 100, 108, 109; 269/21, 258

(56) References Cited

U.S. PATENT DOCUMENTS 4,934,671 A * 6/1990 Laninga et al. ..... 269/20
5,139,245 A * 8/1992 Bruns et al. ..... 269/21
5,395,098 A * 3/1995 Eickhorst et al. ..... 269/21
5,642,943 A * 7/1997 Szeremeta ..... 384/100
6,012,711 A * 1/2000 Cipolla ..... 269/20

* cited by examiner

*Primary Examiner*—Allen Ostrager
*Assistant Examiner*—Jimmy T Nguyen
(74) *Attorney, Agent, or Firm*—Oblon, Spivak, McClelland, Maier & Neustadt, P.C.

(57) ABSTRACT

An apparatus main body 1 is provided with an air supply passage 19 for supplying compressed air for supporting a borne surface 42 in a shape of a projecting spherical surface of an aligning member 4 on a bearing surface 32 in a shape of a partial recessed spherical surface of an air bearing 3 such that the borne surface 42 can be aligned and for floating the aligning member 4 with respect to the air bearing 3. A lock mechanism for locking the aligning member 4 has contact faces 24 and 44 in contact with each other at a locking portion 25 at a tip end of a piston rod driven by a cylinder driving portion 2 and on a face of the aligning member 4 opposite to the borne surface 42 and the contact faces are formed into partial spherical surfaces concentric with the borne surface 42.

10 Claims, 5 Drawing Sheets

AUTOMATIC ALIGNING PRESSING APPARATUS

TECHNICAL FIELD

The present invention relates to a pressing apparatus for pressing a workpiece placed in a slightly inclined state against a target portion with uniform force, for example, and more specifically to an automatic aligning pressing apparatus for uniformly pressing a workpiece such as a semiconductor chip placed on a slightly inclined plane or the like against a target portion by automatically aligning a head for pressing.

PRIOR ART

An automatic aligning pressing apparatus for pressing a workpiece placed on a slightly inclined plane or the like against a target portion with uniform force by automatically aligning a head for pressing is already known.

This type of pressing apparatus generally includes an air bearing having a bearing surface in a shape of a partial recessed spherical surface and an aligning member having a borne surface which is in a shape of a partial projecting spherical surface and which is fitted with the bearing surface and the pressing head for pressing the workpiece is mounted to the aligning member. The aligning member is floated by supplying air between the bearing surface and the borne surface. By pressing the workpiece with the pressing head in this state, the aligning member and the pressing head are automatically aligned according to inclination of the workpiece, thereby uniformly pressing the workpiece against the target position.

Such a pressing apparatus has a lock mechanism for pressing and locking the aligning member after alignment against and to the air bearing. The prior-art lock mechanism presses and locks the aligning member against and to the air bearing by evacuating a gap between the bearing surface and the borne surface. However, it is necessary to increase surface areas of the bearing surface and the borne surface to ensure required suction force in the locking by means of evacuation. Therefore, a size of the apparatus increases adversely.

DISCLOSURE OF THE INVENTION

It is an object of the present invention to provide a small-sized aligning pressing apparatus with low air consumption by which an aligning member can be automatically aligned by floating the aligning member and the aligning member can be locked in an aligned position by mechanical means.

To achieve the above object, an automatic aligning pressing apparatus of the invention comprises: an apparatus main body to be mounted to an automatic device; an air bearing mounted to the apparatus main body and including a bearing surface in a shape of a partial recessed spherical surface at a tip end of the air bearing; an aligning member which includes a borne surface in a shape of a partial projecting spherical surface having the same curvature as the bearing surface of the air bearing and a head mounting face to be mounted with a pressing head for a workpiece and which is supported by the air bearing with the borne surface fitted with the bearing surface; an air supply flow path for supplying compressed air to the bearing surface of the air bearing to float the aligning member from the air bearing; a lock mechanism for pressing and locking the aligning member against and to the bearing surface of the air bearing; and a cylinder driving portion for driving the lock mechanism, wherein the lock mechanism has a piston rod which passes through the air bearing and the aligning member in a position of central portions of the bearing surface and the borne surface in a freely inserted state and which is moved forward and rearward by the cylinder driving portion, a flange-shaped locking portion formed at a tip end of the piston rod, a depression which is formed in the aligning member and in which the locking portion is fitted, and contact faces in shapes of partial spherical surfaces which are formed at the locking portion and the depression to come in contact with each other in locking, and the contact faces are formed concentrically with the borne surface.

In the automatic aligning pressing apparatus with the above structure, if the piston rod is moved forward by the cylinder driving portion, a gap of about 0.02 to 0.05 mm is created between the bearing surface of the air bearing and the borne surface of the aligning member, compressed air is supplied into the gap from the air blowoff hole in the bearing face, and the aligning member is retained in a floating state by an air film. If the pressing head mounted to the aligning member is pressed against the workpiece in this state, because the borne surface and the contact face of the aligning member are concentric with each other, the aligning member is automatically aligned along an inclined face of the workpiece if the workpiece is slightly inclined and the workpiece is uniformly pressed against a target portion.

If the piston rod is drawn back by the cylinder driving portion, the contact face of the locking portion at the tip end of the piston rod comes in contact with the contact face of the aligning member, the aligning member is pressed against the bearing surface of the air bearing, and the aligning member that has been floating is smoothly locked to the air bearing in the aligned position.

By mechanically locking the aligning member through the piston rod by using the cylinder driving portion as described above, it is possible to reduce a size of the pressing apparatus as compared with a prior-art locking method by evacuation and air consumption also reduces.

In the invention, centers of curvature of the bearing surface of the air bearing, the borne surface of the aligning member, and the contact faces of the locking portion and the aligning member are set at a center of a workpiece pressing face of the pressing head mounted to the aligning member. As a result, it is possible to carry out the above floating further stably.

In the invention, it is preferable that the apparatus main body includes in a front end face thereof a depression, the air bearing is fixed to the apparatus main body in the depression, the aligning member is supported by the air bearing, a labyrinth for drawing air and communicating with a gap between the bearing surface and the borne surface is provided between outer peripheral faces of the air bearing and the aligning member and an inner peripheral face of the depression, and the labyrinth communicates with a port for recovering air. As a result, it is possible to recover the compressed air after the compressed air is used for floating the aligning member. Thus, discharge of dust to the surrounding environment can be suppressed and use of the apparatus in a clean room is possible.

In the invention, the air supply flow path extends from a supply port formed in the apparatus main body to pass through a connecting portion between the apparatus main body and the air bearing and to communicate with the blowoff hole opening in the bearing surface and sealing means for preventing air leakage from the connecting portion is provided to the connecting portion. By providing such sealing means, it is possible to reduce the amount of air consumption and to increase burden of the air bearing.

In this case, it is preferable that the sealing means is a heat-resistant annular sealant made of fluoro rubber and the sealing means is inserted into each of an outer peripheral annular groove and an inner peripheral annular groove formed in either one of connecting faces in the connecting portion between the apparatus main body side and the air bearing. As a result, it is possible to use the automatic aligning pressing apparatus even in a high-temperature environment.

It is preferable that the invention further comprises biasing means for applying operating force toward the air bearing side to the aligning member in floating. The biasing means is formed of a magnet, for example, and the aligning member formed of a magnetic substance can be attracted toward the air bearing side by the magnet.

It is preferable that the invention further comprises a rotation preventing mechanism for preventing rotation of the aligning member with respect to the air bearing. The rotation preventing mechanism may be formed of a pin fixed to one of the air bearing and the aligning member and a pin hole which is formed in the other of the air bearing and the aligning member and in which the pin is fitted with a gap around the pin. It is preferable that an elastic body surrounding the pin is disposed in the pin hole.

DETAILED DESCRIPTION

Figure 1:
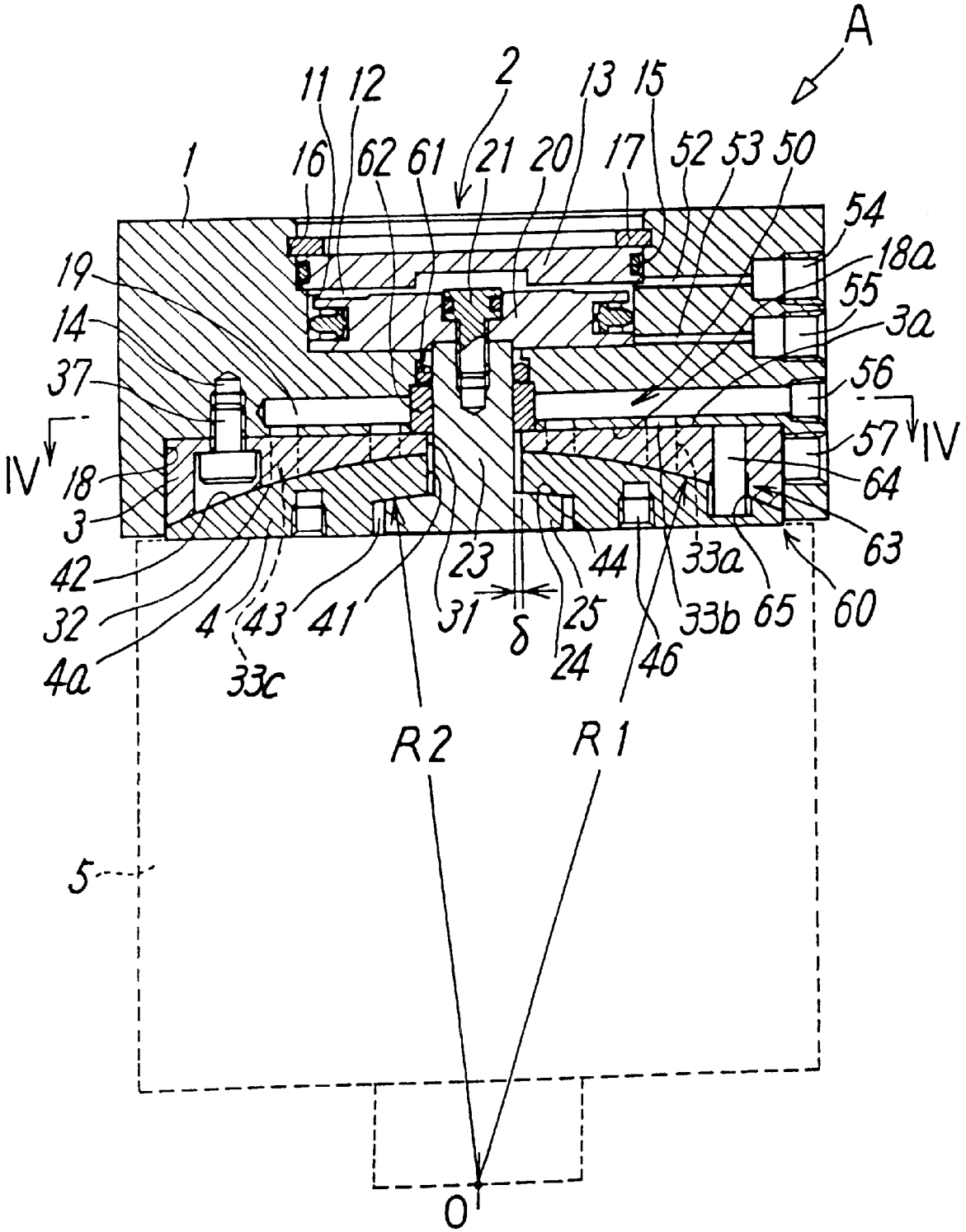
FIG. 1 is a sectional view of a first embodiment of an automatic aligning pressing apparatus according to the present invention.
Figure 2:
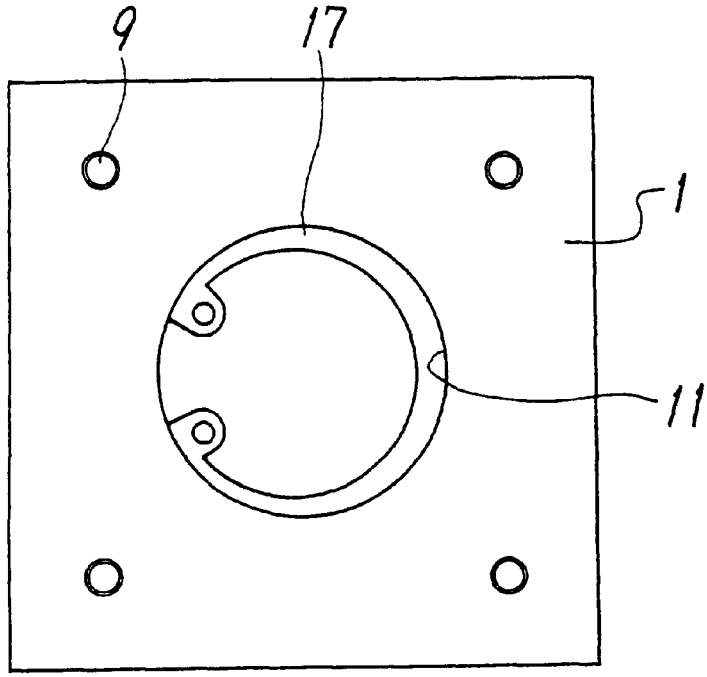
FIG. 2 is a top view of FIG. 1.
Figure 3:
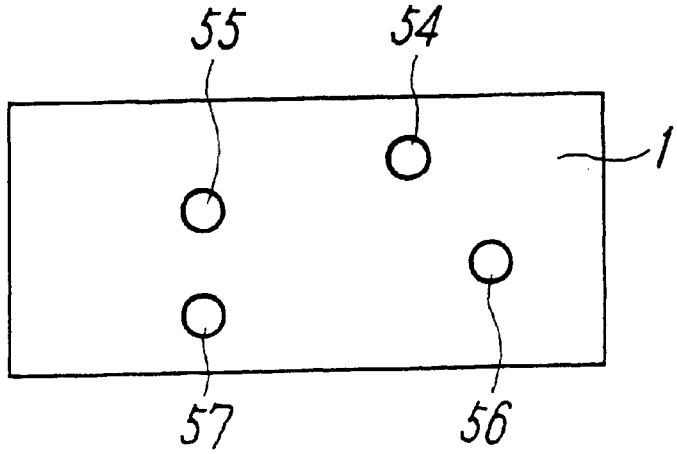
FIG. 3 is a side view of FIG. 1.
Figure 4:
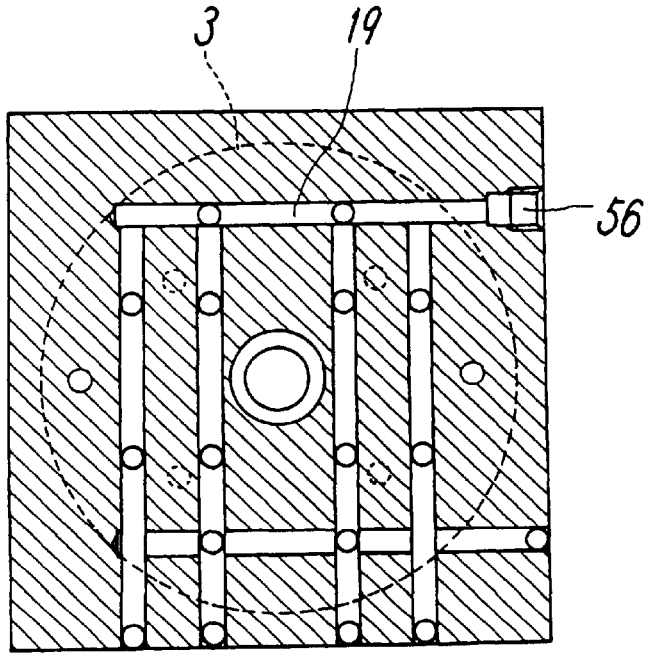
FIG. 4 is a sectional view taken along a line IV—IV in FIG. 1.
Figure 5:
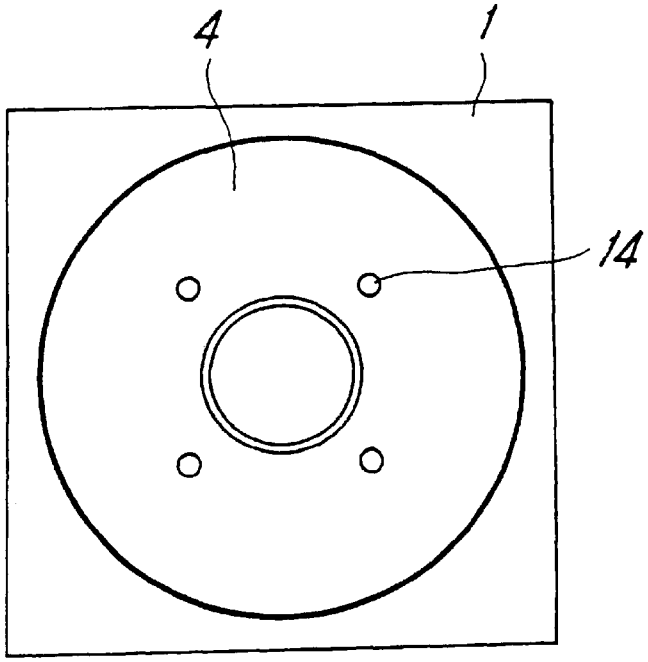
FIG. 5 is a bottom view of FIG. 1.

FIGS. 1 to 5 show a first embodiment of an automatic aligning pressing apparatus according to the present invention. The automatic aligning pressing apparatus A includes an apparatus main body 1 having a cylinder driving portion 2 and in a shape of a rectangular block, an air bearing 3 fixed to the apparatus main body 1, and an aligning member 4 supported by the air bearing 3 such that the aligning member 4 can be aligned. On a front end face of the aligning member 4, a head mounting face 4*a* for detachably mounting a pressing head (bonder head) 5 for pressing a workpiece is formed.

Then, the automatic aligning pressing apparatus A can press the workpiece (not shown) such as a semiconductor chip placed on a slightly inclined plane or the like against a predetermined place with uniform force to mount the workpiece to the place by automatically aligning the workpiece by the pressing head 5 mounted to the aligning member 4 and pressing the workpiece against a target portion.

The cylinder driving portion 2 of the apparatus main body 1 has a piston chamber 12 in the apparatus main body 1, a piston 20 housed for sliding in the piston chamber 12, and a piston rod 23 projecting from the apparatus main body 1 and extending to a lower end portion of the aligning member 4. The rod 23 forms a lock mechanism for mechanically locking the aligning member 4 by pressing the aligning member 4 against the air bearing 3 and is airtightly secured to the piston 20 through a bolt 21 having a sealant. A tip end of the rod 23 is provided with a flange-shaped locking portion 25 and an upper face of the locking portion 25 is formed with a contact face 24 in a shape of a partial projecting spherical surface in contact with a contact face 44 of the aligning member 4. On an inner wall of a through hole which is provided to the apparatus main body 1 and through which the piston rod 23 passes, a sealant 61 and a bearing 62 for airtightly inserting the rod 23 are provided.

The piston chamber 12 is partitioned into an upper piston chamber and a lower piston chamber by the piston 20. In the apparatus main body 1, passages 52, 53 and ports 54, 55 for supplying and discharging compressed air to and from the upper piston chamber and the lower piston chamber are provided.

In order to form the cylinder driving portion 2, a depression 11 that opens on an upper face side is formed in an upper portion of the apparatus main body 1, a cap 13 is airtightly mounted into an upper portion of the depression 11 through a sealant 15, and the piston chamber 12 is defined by the cap 13. To fix the cap 13, a C-shaped snap ring 17 that can be expanded and compressed is mounted into an annular groove 16 in an upper portion of the depression 11 and the cap 13 is pressed against an annular stepped portion of the depression 11 by the snap ring 17.

The apparatus main body 1 has on an upper face thereof a plurality of screw holes 9 (see FIG. 2) and the apparatus main body 1 can be detachably mounted to an automatic device such as a robot arm through bolts screwed down into the screw holes 9.

The apparatus main body 1 is formed in a lower face thereof a circular depression 18 having a certain depth and the air bearing 3 and the aligning member 4 are housed in the depression 18. The air bearing 3 is housed in the depression 18 with a flat back face 3*a* of the air bearing 3 in contact with a flat bottom wall face 18*a* of the depression 18 and is secured to the apparatus main body 1 through bolts 37 screwed down into screw holes 14 in the bottom wall face 18*a*.

Between an inner side wall of the depression 18 and outer side walls of the air bearing 3 and the aligning member 4, a labyrinth or gap 60 for vacuum suction is provided to communicate with a gap between a bearing surface 32 of the air bearing 3 and a borne surface 42 of the aligning member 4 and the labyrinth 60 is connected to an air recovering port 57 formed on a side portion of the depression 18 in the apparatus main body 1.

The air bearing 3 is a disc shape and has the bearing surface 32 in a shape of a partial recessed spherical surface at a tip end of the air bearing 3, the flat back face 3*a*, a hole 31 in a central portion and through which the piston rod 23 passes in a freely inserted state, and a plurality of air passages 33*a* communicating with a plurality of air blowoff holes 33*c* opening in the bearing surface 32. One ends of these air passages 33*a* open in the back face 3*a* and communicate with an air passage 33*b* which opens in the bottom wall face 18*a* of the depression 18 and which is on the apparatus main body 1 side. Through the air passage 33*b* and an air supply passage 19, compressed air is supplied from an air supply port 56 (see FIGS. 1, 3, and 4). In other words, an air supply flow path extending from the air supply port 56 to the air blowoff holes 33*c* in the bearing surface 32 passes through a connecting portion 50 between the apparatus main body 1 and the air bearing 3 in the air passages 33*a* and 33*b* and communicates with the air blowoff holes.

On the other hand, the aligning member 4 is in a disc shape having substantially the same diameter as the air bearing 3, has the borne surface 42 in the shape of the partial projecting spherical surface having the same radius of curvature as the bearing surface 32 of the air bearing 3 on a rear end face of the aligning member 4, and is supported by the air bearing 3 in a state in which the borne surface 42 is fitted with the bearing surface 32. A hole 41 through which the rod 23 passes in the freely inserted state is formed in a central portion of the aligning member 4, a depression 43 having an expanded diameter is formed at a tip end portion of the hole 41, and the locking portion 25 at the tip end of the rod 23 is housed in the depression 43. A bottom wall face of the depression 43 is formed into the contact face 44 in the shape of the partial recessed spherical surface to be in contact with the contact face 24 in the shape of the partial projecting spherical surface of the rod 23 and the contact faces 24 and 44 have the same radius of curvature as each other. There is a relationship as shown in FIG. 1 between the radius R2 of curvature of the contact faces 24 and 44 and the radius R1 of curvature of the borne surface 42 in the aligning member 4 and they share a center O of curvature. The center O of the curvature is preferably set on a center of a workpiece pressing face of the pressing head 5.

The aligning member 4 has in a lower face thereof a plurality of screw holes 46 and the pressing head 5 can be detachably mounted through bolts screwed down into the screw holes 46.

In the automatic aligning pressing apparatus with the above structure, if the piston 20 and the rod 23 are caused to move forward by supplying compressed air from the port 54 to the upper piston chamber, a gap of about 0.02 to 0.05 mm is created between the bearing surface 32 of the air bearing 3 and the borne surface 42 of the aligning member 4. In this gap, compressed air is supplied through the plurality of air blowoff holes 33*c* in the bearing surface 32 from the air passages 33*b* and 33*a* to form an air film, thereby retaining the aligning member 4 in a floating state. At this time, because centers of curvature of the borne surface 42 and the contact face 44 of the aligning member 4 are the same as each other, the aligning member 4 and the pressing head 5 are automatically aligned in the floating state along a face of an object if the object is slightly inclined when the pressing head 5 mounted to the aligning member 4 is pressed against the object.

Compressed air used for floating the aligning member 4 flows from the gap between the bearing surface 32 and the borne surface 42 into the labyrinth 60 and is drawn and recovered from the labyrinth 60 through the air recovering port 57. Thus, discharge of dust to the surrounding environment is suppressed and use in a clean room is possible.

If compressed air is supplied from the port 55 to the lower piston chamber and compressed air is discharged from the upper portion piston chamber to move the piston 20 and the rod 23 rearward in a state in which the aligning member 4 is automatically aligned by pressing the pressing head 5 against the object, the contact face 24 of the locking portion 25 at the tip end of the rod 23 comes in contact with the contact face 44 of the aligning member 4 and the aligning member 4 is drawn toward the air bearing 3. Therefore, the borne surface 42 of the aligning member 4 is pressed against the bearing surface 32 of the air bearing 3 and the aligning member 4 which has been floating is smoothly locked to the air bearing 3 in an aligned position. At this time, because the borne surface 42 of the aligning member 4 is smoothly locked to the bearing surface 32 of the air bearing 3 from the state in which the air film is formed between them, the surfaces 32 and 42 are not gouged by frictional resistance in locking.

By mechanically locking the aligning member 4 by using the cylinder driving portion 2 as described above, it is possible to reduce a size of the pressing apparatus as compared with a prior-art locking method by evacuation and air consumption also reduces.

A swinging amount of the aligning member 4 can be changed by arbitrarily changing a gap 6 between the piston rod 23 and the hole 41 of the aligning mechanism 4 through which the rod 23 passes.

At this time, because a rotation preventing mechanism 63 is provided between the aligning member 4 and the air bearing 3, rotation of the aligning member 4 with respect to the air bearing 3 is prevented. The rotation preventing mechanism 63 is formed of pins 64 fixed to a plurality of positions of the bearing surface 32 of the air bearing 3 with tip ends of the pins 64 projecting and a plurality of pin holes 65 which are formed in the borne surface 42 of the aligning member 4 and in which the pins 64 are fitted with gaps around them. Each the gap between the pin 64 and the pin hole 65 is set to be satisfactorily larger in size than the gap 6 such that the gap does not hinder alignment.

Figure 6:
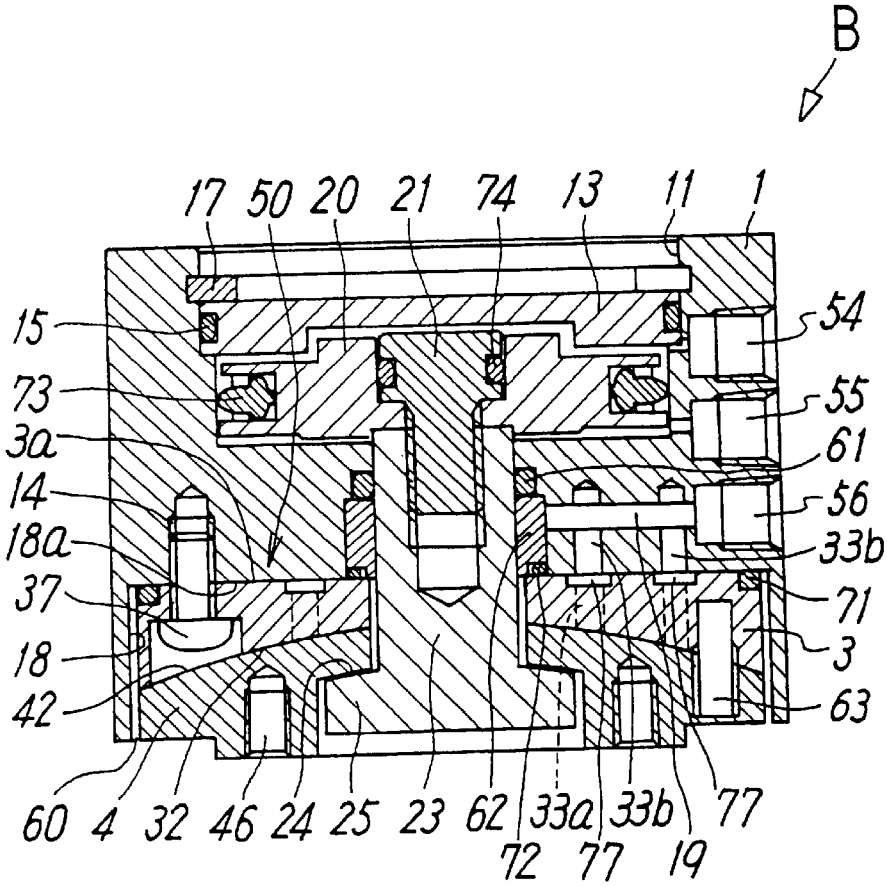
FIG. 6 is a sectional view of a second embodiment of the automatic aligning pressing apparatus according to the invention.

FIG. 6 shows a second embodiment of the automatic aligning pressing apparatus according to the invention. The pressing apparatus B of the second embodiment is different from the first embodiment in that sealing means for preventing air leakage from the connecting portion 50 where the bottom wall face 18*a* of the depression 18 of the apparatus main body 1 and the back face 3*a* of the air bearing 3 are in contact with each other are provided to an outer peripheral position and an inner peripheral position of the connecting portion 50 and that structures of the air supply flow paths for supplying compressed air to the bearing surface 32 are simplified.

In other words, in the second embodiment, similarly to the first embodiment, the air bearing 3 and the aligning member 4 are housed in the depression 18 of the apparatus main body 1 and the air bearing 3 is secured to the apparatus main body 1 through bolts 37 screwed down into the screw holes 14 formed in the bottom wall face 18*a* of the depression 18. The air bearing 3 has the bearing surface 32 in the shape of the partial recess spherical surface for supporting the aligning member 4 through the air film, the plurality of air blowoff holes 33*c* which open in the bearing surface 32, and the air passages 33*a* for supplying compressed air to these air blowoff holes 33*c* from the air supply port and the air supply passage. The air passages 33*a* pass through the connecting portion 50 between the bottom wall face 18*a* of the depression 18 of the apparatus main body 1 and the back face 3*a* of the air bearing 3 and communicate with the air passage 33*b* on the apparatus main body 1 side.

In the second embodiment, the sealing means for preventing air leakage from the connecting portion 50 are provided to an outer peripheral portion and an inner peripheral portion of the connecting portion 50, which is different from the first embodiment. Specifically, annular grooves are provided respectively to a connecting face of either member, e.g., either one of an outer peripheral portion of the bottom wall face 18*a* of the depression 18 of the apparatus main body 1 and an outer peripheral portion of the back face 3*a* of the air bearing 3 and either one of an inner peripheral portion of the bottom wall face 18*a* and an inner peripheral portion of the back face 3*a* and heat-resistant annular sealants 71 and 72 made of fluoro rubber are respectively inserted into the annular grooves.

If the annular groove is formed at the inner peripheral portion of the connecting portion 50, the annular groove may be formed in the bottom wall face 18*a* of the depression 18 in the apparatus main body 1 or may be formed in a face of the bearing 62 forming the same plane as the bottom wall face 18*a* of the depression 18 as shown in FIG. 6. The sealing means in the outer peripheral portion is not necessarily limited to the heat-resistant sealant 71 made of fluoro rubber but may be a heat-resistant adhesive.

By providing the sealing means to the outer peripheral portion and the inner peripheral portion of the connecting portion 50 between the apparatus main body 1 and the air bearing 3 as described above, it is possible to prevent air leakage from the connecting portion 50. Therefore, it is possible to reduce the amount of air consumption and to increase burden of the air bearing 3. If the heat-resistant annular sealant made of fluoro rubber is used as the sealing means, it is possible to use the automatic aligning pressing apparatus of the invention even in a high-temperature environment.

In the second embodiment shown in FIG. 6, the one air supply passage 19 extending laterally from the port 56 in the side face of the apparatus main body 1 toward a center diverges into the plurality of vertical air passages 33*b*. The respective air passages 33*b* respectively communicate with a plurality of annular grooves 77 formed concentrically in the back face 33*a* of the bearing 3 and the respective annular grooves 77 respectively communicate with the air passages 33*a* communicating with the plurality of air blowoff holes 33*c* openings in the bearing surface 32. Therefore, in the second embodiment, the structure of the air supply flow path is simplified as compared with the first embodiment shown in FIG. 4.

A reference numeral 73 designates heat-resistant piston packing made of fluoro rubber and a reference numeral 74 designates a heat-resistant O ring made of fluoro rubber in FIG. 6.

Because the structure of the second embodiment excluding the above-described structure is substantially similar to that of the first embodiment, main component portions similar to those in the first embodiment are provided with similar reference numerals to omit description of them. In the second embodiment, the pressing head 5 is not shown.

Figure 7:
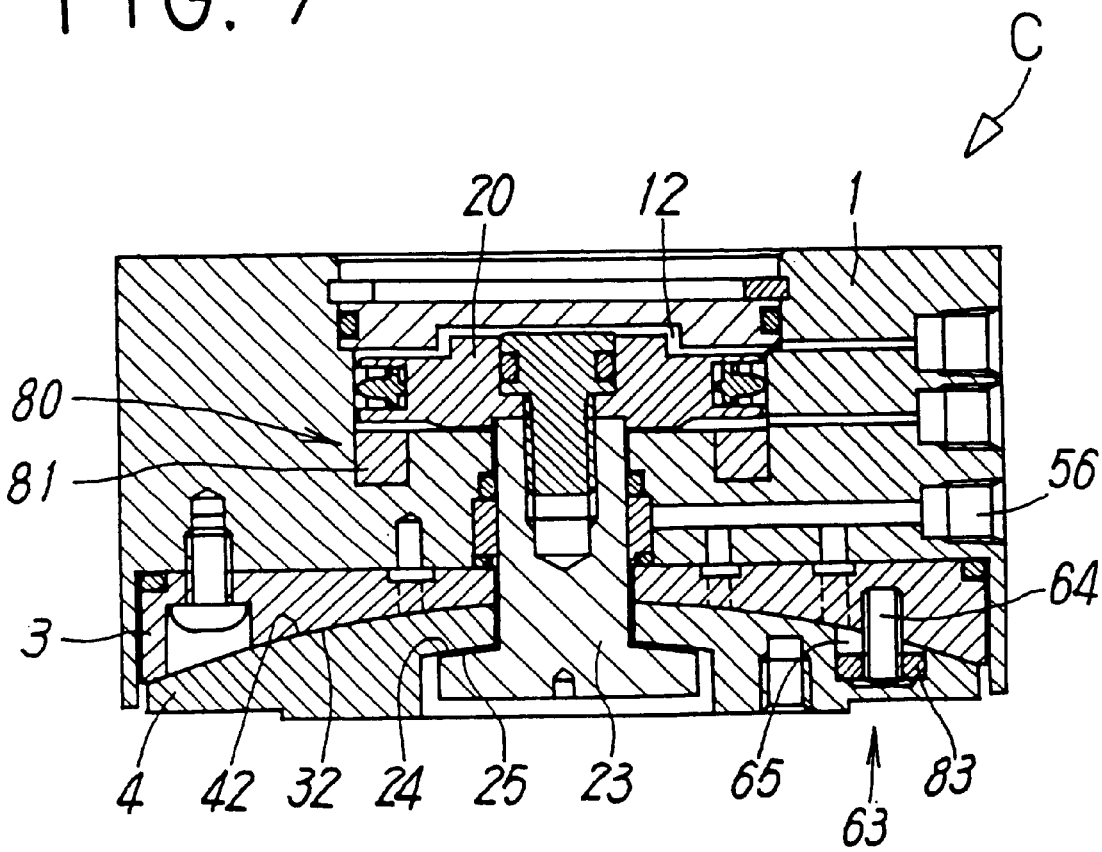
FIG. 7 is a sectional view of a third embodiment of the automatic aligning pressing apparatus according to the invention.

FIG. 7 shows a third embodiment of the invention. A pressing apparatus C of the third embodiment is different from the second embodiment in that biasing means 80 for applying force toward the air bearing 3 to the aligning member 4 in floating so as to improve an aligning property of the aligning member 4 is newly added and that a few improvements are made to the rotation preventing mechanism 63 for preventing rotation of the aligning member 4.

In other words, in the pressing apparatus C, the aligning member 4 is formed of a magnetic substance and a magnet 81 is disposed in the apparatus main body 1 so as to attract the aligning member 4 toward the air bearing 3 side. The magnet 81 is in an annular shape and is disposed in a mounting groove formed in a bottom portion of the piston chamber 12 in the apparatus main body 1 to concentrically surround the piston rod 23. Thus, attracting force of the magnet 81 uniformly acts on the aligning member 4.

By providing such biasing means 80, the aligning member 4 floats while being attracted toward the air bearing 3 by constant force. Therefore, the floating state is stabilized and a thickness of the air film between the bearing surface 32 and the borne surface 42 is made substantially uniform. As a result, rigidity as a hydrostatic bearing against a load increases and the aligning property of the aligning member 4 is improved.

The position to which the magnet 81 is mounted may be the piston 20 or the air bearing 3. It is also possible that the biasing means 80 is formed of a spring instead of the magnet 81 and that the spring is disposed to bias the aligning member 4 toward the air bearing 3 side with spring force of the spring.

On the other hand, the rotation preventing mechanism 63 of the third embodiment has the pins 64 mounted to the bearing surface 32 of the air bearing 3 and the pin holes 65 which are formed in the borne surface 42 of the aligning member 4 and in which the pins 64 are fitted with gaps around them. In each the pin hole 65, an annular elastic body 83 surrounding the pin 64 is disposed. The elastic body 83 is made of rubber, synthetic resin, or the like. As a result, if the aligning member 4 is inclined by a large amount with respect to the air bearing 3 in alignment, each the elastic body 83 prevents the pin 64 from coming into direct contact with a hole wall of the pin hole 65 and friction is not generated between the pin 64 and the hole wall. Therefore, reduction of the aligning property due to the friction can be prevented.

It is also possible to form the pins 64 on the borne surface 42 of the aligning member 4 and to form the pin holes 65 in the bearing surface 32 of the air bearing 3 in a manner opposite to the embodiment shown in the drawing. This is also true for the first and second embodiments.

Because the structure of the third embodiment excluding the above-described structure is substantially similar to that of the second embodiment, main component portions similar to those in the second embodiment are provided with similar reference numerals to omit description of them.

As described above, according to the invention, it is possible to provide the small-sized automatic aligning pressing apparatus with low air consumption by which the aligning member can be automatically aligned in a floated state and can be locked and pressed in the aligned position.

What is claimed is:

1. An automatic aligning pressing apparatus comprising:

an apparatus main body to be mounted to an automatic device;

an air bearing mounted to said apparatus main body and including a bearing surface in a shape of a partial recessed spherical surface at a tip end of said air bearing;

an aligning member which includes a borne surface in a shape of a partial projecting spherical surface having a same curvature as said bearing surface of said air bearing and a head mounting face to be mounted with a pressing head for a workpiece and which is supported by said air bearing with said borne surface fitted with said bearing surface;

an air supply flow path for supplying compressed air to said bearing surface of said air bearing to float said aligning member from said air bearing;

a lock mechanism for pressing and locking said aligning member against and to said bearing surface of said air bearing;

and a cylinder driving portion for driving said lock mechanism, wherein said lock mechanism has a piston rod which passes through said air bearing and said aligning member in a position of central portions of said bearing surface and said borne surface in a freely inserted state and which is moved forward and rearward by said cylinder driving portion, a flange-shaped locking portion formed at a tip end of said piston rod, a depression which is formed in said aligning member and in which said locking portion is fitted, and contact faces in shapes of partial spherical surfaces are formed at said locking portion and said depression, the contact face of the locking portion comes into contact with the contact face of the depression in locking, and said contact faces are formed concentrically with said borne surface.

2. An automatic aligning pressing apparatus according to claim 1, wherein a center of curvature of said bearing surface of said air bearing, a center of curvature of said borne surface of said aligning member, a center of curvature of the contact face of the depression of said contact face of said locking portion, and a center of curvature of the contact face of the depression of said aligning member are set at a center of a workpiece pressing face of said pressing head mounted to said aligning member.

3. An automatic aligning pressing apparatus according to claim 1, wherein said apparatus main body includes in a front end face thereof a depression, said air bearing is fixed to said apparatus main body in said depression, said aligning member is supported by said air bearing, a first gap for drawing air and communicating with a second gap between said bearing surface and said borne surface is provided between outer side faces of said air bearing and said aligning member and an inner side face of said depression, and said first gap communicates with a port for recovering air.

4. An automatic aligning pressing apparatus according to claim 1, wherein said air supply flow path for supplying said compressed air to said bearing surface of said air bearing extends from a supply port formed in said apparatus main body to pass through a connecting portion between said apparatus main body and said air bearing and to communicate with a blowoff hole opening in said bearing surface and sealing means for preventing air leakage from said connecting portion is provided to said connecting portion.

5. An automatic aligning pressing apparatus according to claim 4, wherein said sealing means is a heat-resistant annular sealant made of fluoro rubber and said sealant is inserted into each of an outer peripheral annular groove and an inner peripheral annular groove formed in either one of connecting faces in said connecting portion between said apparatus main body side and said air bearing.

6. An automatic aligning pressing apparatus according to claim 1 further comprising biasing means for applying operating force toward said air bearing to said aligning member in floating.

7. An automatic aligning pressing apparatus according to claim 6, wherein said biasing means is formed of a magnet, said aligning member is formed of a magnetic substance, and said aligning member is attracted toward the air bearing by said magnet.

8. An automatic aligning pressing apparatus according to claim 1 further comprising a rotation preventing mechanism for preventing rotation of said aligning member with respect to said air bearing.

9. An automatic aligning pressing apparatus according to claim 8, wherein said rotation preventing mechanism is formed of a pin fixed to one of said air bearing and said aligning member and a pin hole which is formed in the other of said air bearing and said aligning member and in which said pin is fitted with a gap around said pin.

10. An automatic aligning pressing apparatus according to claim 9, wherein an elastic body surrounding said pin is disposed in said pin hole and said elastic body prevents said pin from coming in direct contact with a hole wall of said pin hole.

* * * * *